US007646676B2

(12) United States Patent
Howard

(10) Patent No.: US 7,646,676 B2
(45) Date of Patent: Jan. 12, 2010

(54) SYNCHRONOUS RE-SAMPLING BASED SIGNAL EXTRACTION

(75) Inventor: Robert J. Howard, Clifton, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 201 days.

(21) Appl. No.: 11/773,055

(22) Filed: Jul. 3, 2007

(65) Prior Publication Data

US 2009/0010100 A1 Jan. 8, 2009

(51) Int. Cl.
*H01B 1/06* (2006.01)

(52) U.S. Cl. ..... 367/135

(58) Field of Classification Search ..... 367/135, 367/136

See application file for complete search history.

(56) References Cited

U.S. PATENT DOCUMENTS

2009/0010100 A1* 1/2009 Howard ..... 367/13

* cited by examiner

*Primary Examiner*—Dan Pihulic
(74) *Attorney, Agent, or Firm*—Whitham, Curtis, Christofferson & Cook, P.C.

(57) ABSTRACT

Sampling of a captured signal is synchronized to a tonal which may be unstable in frequency detected in the signal to cause it and all of its harmonics, sub-harmonics and fundamental to appear to have a substantially constant frequency relative to the sampling rate even if some related signals are otherwise undetectable amid noise. By adjusting an integration period of a fast Fourier transform to extract an intrinsic bandwidth, substantial signal processing gain can be obtained for the tonal and harmonically related signals, even if otherwise undetectable. Signal processing may be performed in either the time domain or the frequency domain. Recursive processing is performed to observe unrelated tones by grouping of tones which are harmonically related and supports detection of relationships between acoustic signal sources.

20 Claims, 6 Drawing Sheets

SYNCHRONOUS RE-SAMPLING BASED SIGNAL EXTRACTION

BACKGROUND OF THE INVENTION

1. Field of the Invention

The present invention generally relates to the identification and classification of sound sources and, more particularly, to detection and improvement of signal-to-noise ratio of otherwise undetectable harmonics and/or sub-harmonics of detectable but unstable tones.

2. Description of the Prior Art

The identification and classification of sound sources remains an important aspect of commercial and applied acoustics, particularly in regard to underwater environments where the opportunity for visual or other mechanisms for observation are very limited or lacking altogether. However, detection of sounds which may emanate from a sound source of interest usually requires isolation of sounds at a relatively low level from among relatively high levels of noise or sounds from other sources even though relatively few sound sources which are likely to be of interest are stable in frequency, phase or waveform and a relatively large amount of information and signal excess or detail is likely to be lost by filter mismatch relative to signal characteristics, particularly if stability of frequency is assumed.

When performing acoustic source classification or identification, it is important to identify tones with harmonic families and to identify as many harmonics as possible for each source. It is often the case that tones from different sources are close in frequency but differ in instability patterns or speed behavior. Speed behavior (e.g. variation in frequency due to load variations such as flow and density variation for a pump) that is only loosely coupled to the acoustic source is often encountered.

Techniques known as "order tracking" are known and have been used is the automobile industry to improve extraction and analysis of noise sources which are dependent on engine rotational speed as well as numerous other applications in other fields such as in adaptive filters and the like. As usually practiced, a basic feature of such techniques is to measure engine RPM, which will necessarily be slightly variable and unstable even when held as closely as possible to a constant rotational speed, and then re-sample a recording of captured noise at a sampling rate which corresponds accurately to the measured rotational speed. This, in effect, holds the apparent rotational speed to a constant value since the sampling rate tracks variations in the actual rotational speed. As a result, all of the hard coupled engine-related noises also appear to have a constant frequency in the re-sampled data and thus become much easier to detect, analyze and isolate. These applications are generally interested in signals having a high signal-to-noise ratio (SNR) in a relatively rich background of narrow band signals.

More generally, it is relatively easy for a trained analyst to identify lines (e.g. detected tones or spectral lines) in a signal which have the same instability pattern, assuming they have sufficient amplitude to be detected at all in a given noisy signal. Order tracking thus uses an external reference such as a tachometer to directly control the clock of an analog to digital (A/D) converter or, alternatively, to control re-sampling of a co-recorded digital signal (e.g. a tachometer output). Unless the reference is digitized at the same time as the acoustic signal to be processed or analyzed, aligning the signal to be processed or analyzed with the co-recorded signal presents significant technical challenges.

Thus order tracking is not applicable to a so-called "blind analysis" because it assumes a reference and that all signals of interest are related to the reference (e.g. a rotation rate of an engine); a condition which cannot be met with an unknown or non-cooperative acoustic signal source or when multiple acoustic signal sources are co-mingled into a single acoustic or vibration signal.

Further, order tracking, by its nature, is designed around significant change in frequency in a short period of time.

There are many marine sources which produce unstable tonals, including diesel engines, DC auxiliaries and most propulsion plants. Some AC auxiliaries also produce unstable tonals, such as induction motors which vary in rotational speed and electrically related sound emanations with changes in mechanical load. Land based machinery often exhibits similar characteristics. Additionally, other contributions to frequency instability may be caused by flows and thermal or density gradients in gas or liquid between the sound source and the sound detection apparatus, Doppler effects due to relative movement of the sound source and detection apparatus, reflections from fixed or moving surfaces in the environment and the like. Further, full analysis and classification or identification of sound sources generally requires relatively detailed matching of sound spectral content which is compromised if some spectral components of the sound are undetected or undetectable amid noise. Further, "order tracking" techniques generally rely upon detection or at least approximate knowledge or prior independent measurement of a fundamental frequency whereas, in classification or identification of an unknown sound source, the fundamental frequency may not only be unknown, but may be below the frequency range detectable by current equipment particularly sonar equipment in underwater applications.

SUMMARY OF THE INVENTION

It is therefore an object of the present invention to provide an apparatus and methodology to detect and improve the signal-to-noise ratio (SNR) of otherwise undetectable tones related to one or more detectable tones; the signal-to-noise ratio of which may also be enhanced in accordance with the invention and which may be tracked in accordance with the invention regardless of frequency instabilities therein. Once such an otherwise undetectable tone has been detected and its SNR improved, further otherwise undetectable tones can be detected and/or their SNR enhanced to support capture of an optimally complete spectral signature to support improved classification and/or identification of a noise source.

In order to accomplish these and other objects of the invention, a method of acoustic signal processing is provided including steps of detecting a tonal within an acoustic signal, sampling the acoustic signal at a rate approximating an instantaneous frequency of the tonal, setting an integration period of fast Fourier transform frame size for the signal resulting from the sampling step in accordance with an approximation of an intrinsic bandwidth of the tonal, and observing a portion of a spectrum of the acoustic signal in accordance with a result of the setting step.

In accordance with another aspect of the invention, a method of acoustic signal processing is provided comprising steps of sampling an acoustic signal, performing a spectral analysis of the acoustic signal, selecting a reference tone from a result of the step of performing spectral analysis, tracking frequency of the selected reference tone, re-sampling the acoustic signal in accordance with a result of the tracking step to stabilize the selected tone and components of the acoustic signal having any constant frequency ratio to the reference tone, and observing a portion of a spectrum of a result of the re-sampling step.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
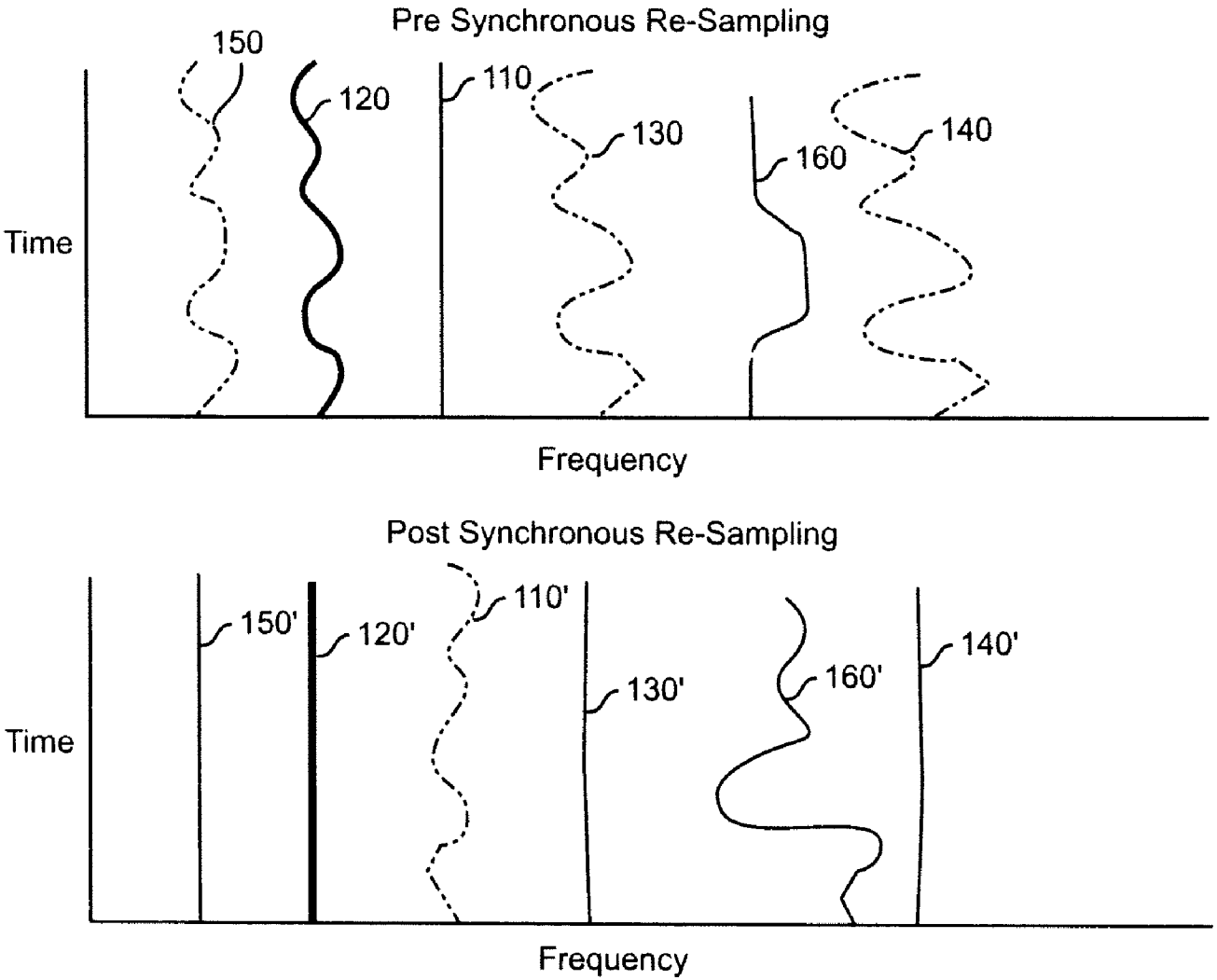
FIG. 1 is a graphical depiction useful for conveying an understanding of the invention, particularly in comparison with "order racking" techniques.

Referring now to the drawings, and more particularly to FIG. 1, there is shown two graphs of variation of frequency over time of exemplary signals before and after synchronous re-sampling in accordance with the invention. It should be understood that while the term "re-sampling" will be used since it is contemplated that the invention will be principally employed in the analysis of signals which have been captured and recorded and then subjected to sampling (consistent with Nyquist criteria) for initial analysis and then re-sampled based on results of the initial analysis, the invention can also be practiced in substantially real-time without recording of the signals. It should also be noted that re-sampling is nominally performed on digital signals since special synchronization, generally requiring interpolation filters, is required for re-sampling to be performed on an analog signal, as captured. Re-sampling can be performed on either time domain or frequency domain signals. By the same token, details of any recording process which may be utilized is relatively unimportant to the practice of the invention as long as fidelity of the recording is sufficient to support sampling at slightly different frequencies.

In accordance with the present invention, a re-sampling reference signal is extracted "in the blind" from an acoustic signal which may or may not be associated with an acoustic source which may be of interest. That is, there is no independent reference signal as is assumed in order tracking arrangements alluded to above but, rather, a relatively strong tone in the acoustic (or other) signal is used as a trial reference signal for re-sampling and re-examining the resulting power spectrum corresponding to the strong tone/trial reference signal and then repeating the process until all strong or detectable tones in a signal are accounted for. Since adaptive re-sampling in accordance with the invention can improve signal processing gain and signal-to-noise ratio (SNR) additional tones which are otherwise undetectable can be found and enhanced. As tones are extracted and assigned to respective harmonic families in accordance with respective trial reference signals, they are eliminated from consideration as further reference signal candidates. The classification, tracking and possible identification processing in accordance with the invention thus can follow a recursive hypothesis testing procedure to identify as many harmonics as possible for each acoustic source while effectively isolating each acoustic source from every other acoustic source; thus obtaining an acoustic signature (or portion thereof) for each acoustic source.

As a result, the invention is capable of assigning lines from multiple harmonic families to the correct source such as when a generator is used to drive an induction motor which is, in turn, used to drive a pump. In such a circumstance, the instability of the generator and the instability of the motor will interact such that the motor, generator and pump will all exhibit some instability components associated with all other operatively associated elements. Thus the invention is capable of not only supporting classification of particular acoustic sources but, in many cases, supporting observation of their operative associations within a source of a composite acoustic signal which may be extremely complex, such as a ship or submarine, and which may allow important information about the structure and/or operation thereof to be discerned.

In the upper graph of FIG. 1 illustrating variation in frequencies present in a spectrum of an arbitrary signal over time, a constant frequency tone 110 is included for reference. Tone 120 is a relatively strong tone and detectable using known techniques but is somewhat variable or unstable in frequency. Tones 130, 140 and 150 depicted in chain lines are tones much weaker than tone 120 and having magnitudes comparable to the noise levels in the signal and are thus not readily detectable by known techniques. It should also be noted that tones 130, 140 and 150, for purposes of this discussion, are depicted as varying in frequency in a manner similar to that of tone 120 to which it is assumed they are related as harmonics of sub-harmonics or a fundamental thereof. By the same token, the waveform of the signal corresponding to tone 120 is unimportant to an understanding of the principles of the invention and variation from a sinusoidal waveform may be present as harmonics, sub-harmonics or a fundamental tone which may vary arbitrarily in amplitude over time. A further unstable tone 160 which is assumed to be unrelated to tone 120 is also illustrated for comparison.

Since tone 120 can be detected, its instantaneous frequency can be determined and tracked using any of a number of known techniques or devices, such as a phase locked loop (PLL) circuit which, while not preferred for practice of the invention, will be useful for explanation thereof because of its simplicity and familiarity in the art. Such a circuit detects a feature of the waveform, preferably for purposes of the invention, a zero crossing of the waveform of tone 120, and effectively predicts the next such zero crossing by using a variable frequency oscillator operating at a higher frequency and dividing that frequency to approximate the frequency of tone 120. Depending on whether the next actual zero crossing (or other feature) of the waveform corresponding to tone 120 occurs before or after the predicted time, a signal is generated which adjusts the variable frequency oscillator in a manner to match the frequency of tone 120.

If, for example, the sampling frequency is now controlled to follow or track the frequency variation of detectable tone 120, (e.g. such that samples of tone 120 are synchronized to zero crossings of the corresponding waveform) each cycle of the waveform corresponding to tone 120 will be sampled an equal number of times and thus will appear to have a constant frequency relative to the sampling frequency as shown at 120' of the lower graph of FIG. 1. Moreover, tones 130', 140' and 150' will also appear to have a constant frequency relative to the sampling rate while tone 110 which is actually of constant frequency will appear to vary in frequency relative to the sampling rate in a complementary fashion to the actual variation in frequency of original tone 120. This type of variable or adaptive sampling is referred to hereinafter as "synchronous re-sampling" and the phrase "apparent constant frequency" will be used from time-to-time hereinafter to refer to a frequency of a tone which is actually variable but has a consistent and constant relationship to an adaptive sampling rate. In contrast, unrelated tone 160 will appear to vary even more widely as shown at 160'; the variation being the sum of the frequency variation of both tones 120 and 160.

It should be appreciated in regard to this terminology that if the samples obtained through synchronously re-sampling of a variable frequency tone are played out at constant rate, the played out tone will, in fact, have a constant (and arbitrarily adjustable; depending on the rate at which the samples are played out) frequency which can be detected, processed, tracked and/or enhanced much more easily than a tone which is unstable in frequency. Thus, in accordance with the present invention, once a relatively strong candidate tone (e.g. tone 120) is identified in a signal, it can be tracked in phase and frequency and used to control a re-sampling filter. The re-sampling filter can then adjust the frequency of the reference tone to some predetermined value in the output data stream; which effect will also apply to all harmonically related tones (e.g. 130, 140 and 150) such that they will have an essentially constant frequency, as well. It should also be appreciated that synchronous re-sampling in accordance with the invention is distinguished from known "order tracking" techniques alluded to above at least by tracking a tone in the original signal rather than adjusting sampling rates to some known or measured variable parameter.

More generally, the process of synchronous re-sampling can be modeled as:

$$S(t) = \sum_n a_n e^{i \cdot r_n \cdot \omega_n (1+\Omega(t))t} + N(t)$$

where

S(t) is the measured signal,
t is time,
$\omega_o$ is a fixed angular frequency,
n is a fixed integer,
$r_n$ is a constant, floating point number for each n,
Ω(t) is a slowly varying, zero mean function of t, and
N(t) is random noise.

If t is mapped into t' such that $$t' = (1/(1+\Omega(t)) \cdot t,$$
$$\doteq (1-\Omega(t)) \cdot t, \text{ if } \Omega(t) << 1, \text{ and}$$
$$S(t') = \sum_n a_n e^{i \cdot r_n \cdot \omega_n (1+\Omega(t))t'} + N(t')$$

The point of this transformation is to produce a new signal, S(t') that cancels the effects of Ω(t) and produces constant frequency signals for related tonals. It should be noted that this definition of t' requires that one of the "harmonics" (e.g. possibly the fundamental) be selected and assigned a ratio $r_n$=1.0. If $$\Omega(t) << 1.0$$

then t' may be approximated by:

$$t' = t'' = (1-\Omega(t))t.$$

In other words, $$t' = t/(1+\Omega(t)) = t(1-\Omega(t)) \text{ if } \Omega(t) << 1.$$

This condition is almost always achieved for unstable lines but may not obtain for speed dependent lines. When |Ω(t)| is not much less than 1, the first form, t', must be used. Otherwise t" is preferred. In addition, Ω(t) must be estimated from the signal applications (e.g. anti-submarine warfare (ASW)). Thus if Ω'(t) is an estimate of Ω(t) from a strong harmonic, we obtain $$t' = (1/(1+\Omega'(t))) \cdot t$$
$$\approx (1-\Omega'(t))t = t''.$$

In practice, either t' or t" can be used but the first form is preferred if computational loading permits. Thus, the modified signal becomes $$S(t') \approx S(t'') = \sum_n a_n e^{i \cdot r_n \cdot \omega_n t''} + N(t'')$$

This condition which is devoid of any Ω(t) term will be referred to hereinafter as synchronous re-sampling.

As alluded to above, any of several well known techniques can be used to track the frequency and/or phase of a reference tone and thus obtain Ω'(t). Line trackers become more effective with increasing signal to noise ratio (SNR). That is, as the SNR increases, the stability and accuracy of any tracker will increase. In addition, as SNR increases, the number of available (e.g. applicable) line tracker algorithms increases. Further, once the input has been re-sampled to provide a more stable apparent frequency (or actual frequency) the resulting signal may then be subjected to any of a number of narrow band analysis techniques which can, for example, improve the SNR.

To a first approximation, the accuracy with which the frequency of a relatively strong line or tonal can be tracked is given by $$\Delta F = 1/(T \cdot SNR)$$

where

ΔF is the error in the frequency estimate
T is the observation time, and
SNR is the signal to noise ratio.

This formula follows directly by assuming that the frequency is estimated by counting the zero crossings in some time period, T, and noting that the uncertainty in the zero crossing times is approximately 1/SNR. More accurate formulas can be developed but the formula given above is sufficient for an understanding and for enablement of the successful practice of the invention. In this regard, it is important to note that most known line trackers use narrow band filters in some form to improve the SNR of the line corresponding to the strong or reference tone.

Figure 2:
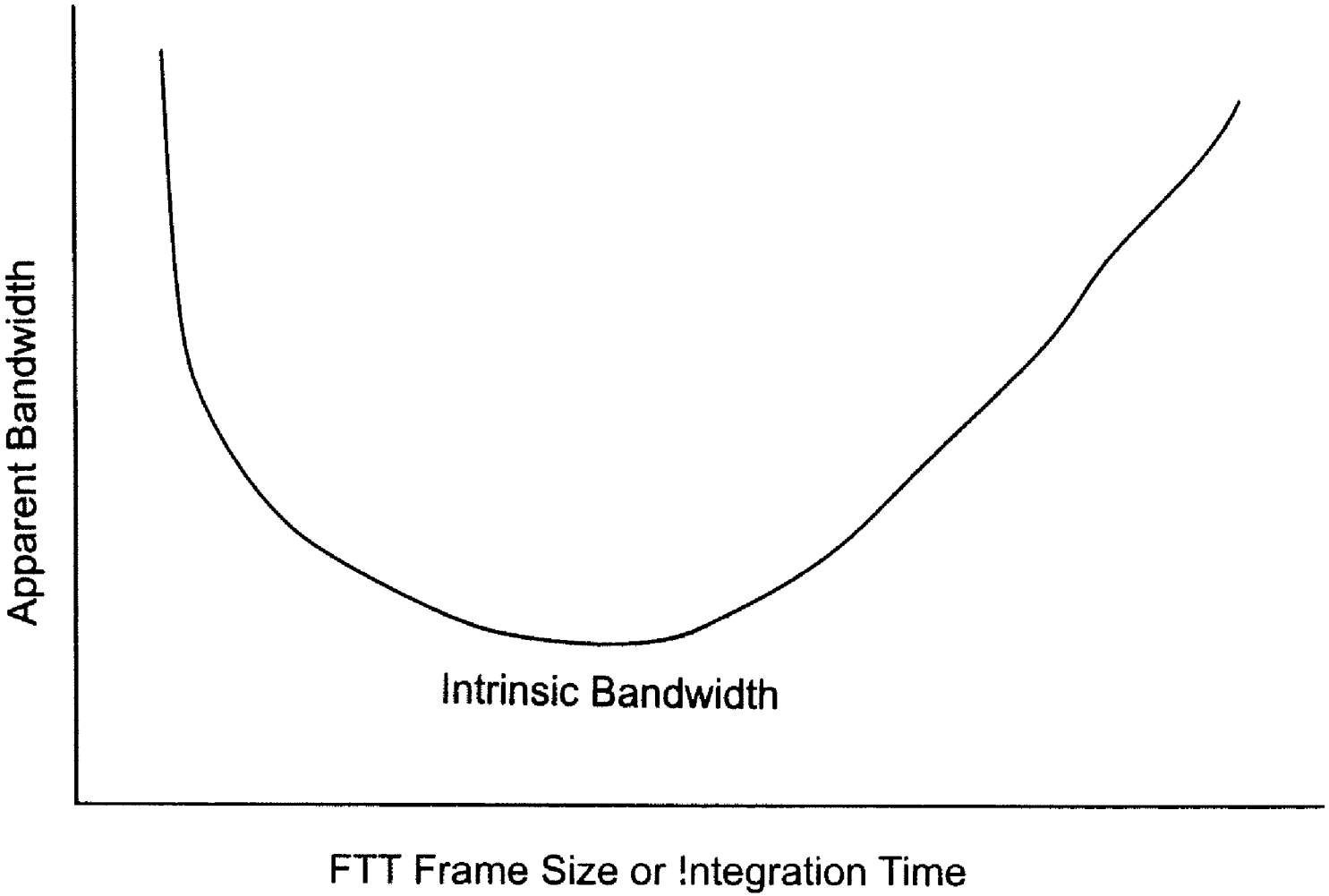
FIG. 2 is a graphical depiction useful for conveying an understanding of intrinsic bandwidth of an unstable signal.

Referring now to FIG. 2, unstable tones are often observed to have an "intrinsic" bandwidth that is several orders of magnitude smaller than the long term bandwidth of the line (e.g. the maximum excursion of the variable frequency). In some literature, the long term behavior is referred to as line instability. The intrinsic bandwidth is, for purposes of this discussion of the invention, defined as the bandwidth measurable by a single fast Fourier transform (FFT), for the performance of which, circuits and algorithms are well-known and widely available, with integration time optimized to produce the minimum value. Accordingly, the intrinsic bandwidth of an unstable tone can usually be extracted from a signal by selecting the fast Fourier transform (FFT) integration period that produces the smallest possible bandwidth within each FFT, as illustrated in FIG. 2.

At the crudest levels, the adjustments needed to extract the intrinsic bandwidth can be made directly to the FFT outputs from standard frequency analysis. Such an approach can be easily implemented but sacrifices some signal processing gain, particularly when strong reference tonals are available. Interpolation of the peak frequency of the tone can be used to good advantage if the FFT outputs are used directly. Even so, there are significant algorithmic difficulties and trade-offs in deciding how to allocate energy of the signal between bins corresponding to respective frequency ranges that appear to contain mostly noise. The choice of bin widths for a purely frequency domain approach will never be ideal for all tonals and, at best, can be selected to be optimal for only a single frequency.

In contrast, the use of time-domain trackers allows sample-by-sample adjustments and presents the possibility of using a variety of FFT frame sizes on the re-sampled data. By being thus able to match the FFT frame size to the intrinsic bandwidth of the reference tone, the maximum possible signal processing gain can be achieved. In this regard, it should be noted that synchronous re-sampling cannot increase the signal processing gain by more than the SNR of the reference tone. In most cases, the actual, available signal processing gain is expected to be less than the SNR of the reference tone. Noise in the frequency estimates of the reference tone will thus set the lower limit of the apparent bandwidth (e.g. the intrinsic bandwidth) of the reference tone and all of its harmonics and sub-harmonics in the re-sampled signal.

Figure 3:
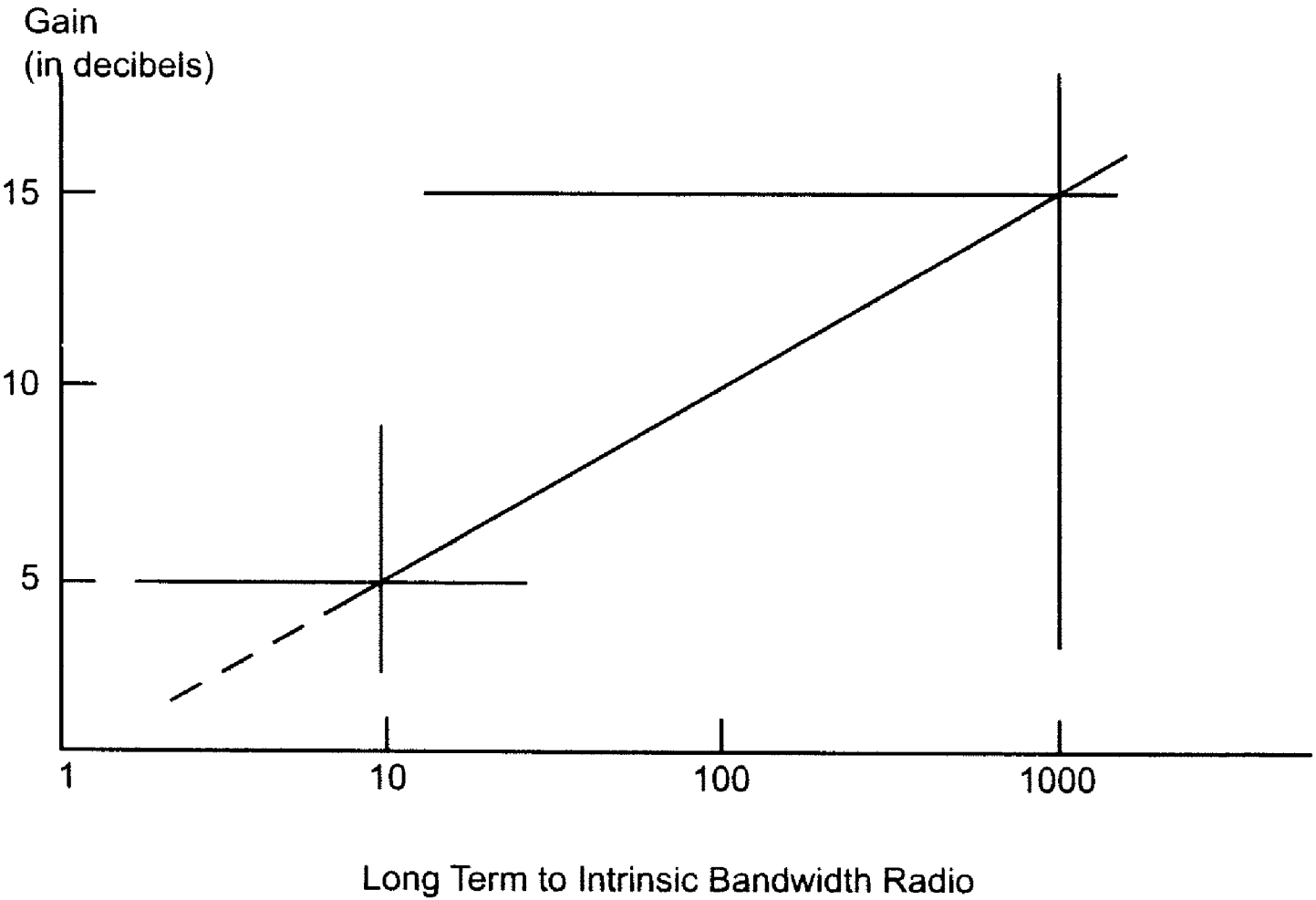
FIG. 3 is a graphical depiction illustrating the relationship of intrinsic bandwidth and long term bandwidth of an unstable signal.

Tonal frequency changes can be broadly classified as instability driven or speed driven. Instability driven tonals can have bandwidths ranging from nearly zero percent of center frequency to as high as five percent of center frequency. The signal processing gain for the post re-sampled data will thus be on the order of 5 $\log_{10}$ (pre-resampled bandwidth/post re-sampled bandwidth) which can be substantial as can be appreciated from the graphical comparison of FIG. 1 and as specifically depicted in FIG. 3 which illustrates the signal processing gain which can be achieved by stabilizing the signal so that all energy from the tone sums into the same FFT bin. That is, provided that sufficient integration time is available and provided the reference tone has sufficient SNR, synchronous re-sampling can produce as much as 10 to 15 db of signal processing gain which, in turn, can allow detection of harmonics and other coupled or related line sources (e.g. lines 130, 140 and 150 of FIG. 1) that would otherwise be undetectable in the absence of such signal processing gain. Further, additional gain for higher harmonics can be obtained by synchronizing re-sampling to other originally undetectable tones detected through re-sampling based on another reference tone. Such additional tonals and their behavior (e.g. amplitude variations with reference tone variation, possibly due to resonances) can be invaluable in classification of tonal sources and equipment health.

A similar analysis applies to speed dependent tonals (e.g. tones whose frequency is a function of platform speed through a medium such as water). However, t' must be used to control re-sampling in this case. Additional signal processing gain derived from synchronous re-sampling can be used to detect lower level tones. For example, using a propeller blade or shaft line as a reference to re-sample a recording, it may be possible to detect gear tones that might otherwise escape detection and may be equally valuable in tonal source classification.

Another advantage of synchronous re-sampling is the relative ease with which harmonics can be identified. The spectrum of the re-sampled signal will tend to exhibit tones that are related to the reference tone as very stable lines, sometimes referred to as cursors. At the same time, tones that are not related to the reference tone will tend to be suppressed due to increased apparent frequency variation as can be appreciated from comparing lines 160 and 160' in FIG. 1 even if relatively stable in the re-sampled data since any difference in the frequency variation from the reference tonal will greatly reduce the amplitude of the integrated (e.g. summed) FFT frames of the corresponding spectral line of the unrelated tonal source. This behavior suggests that it will be advantageous to apply synchronous re-sampling as illustrated in FIG. 4 to as many different tones as possible, limited only by the number of distinct instability patterns and speed dependencies that may exist in the original data from a collective or composite source including many individual related or unrelated acoustic sources.

Figure 4:
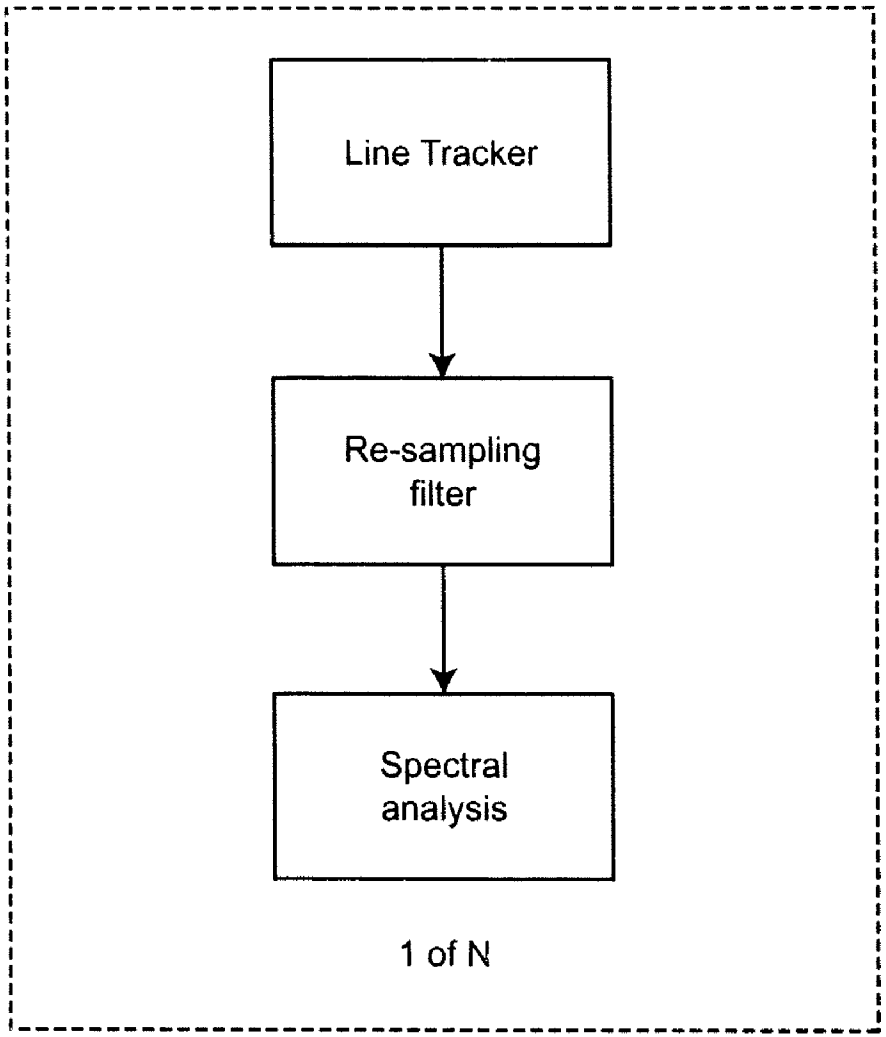
FIG. 4 is a block diagram or high-level flow chart illustrating the invention.
Figure 5:
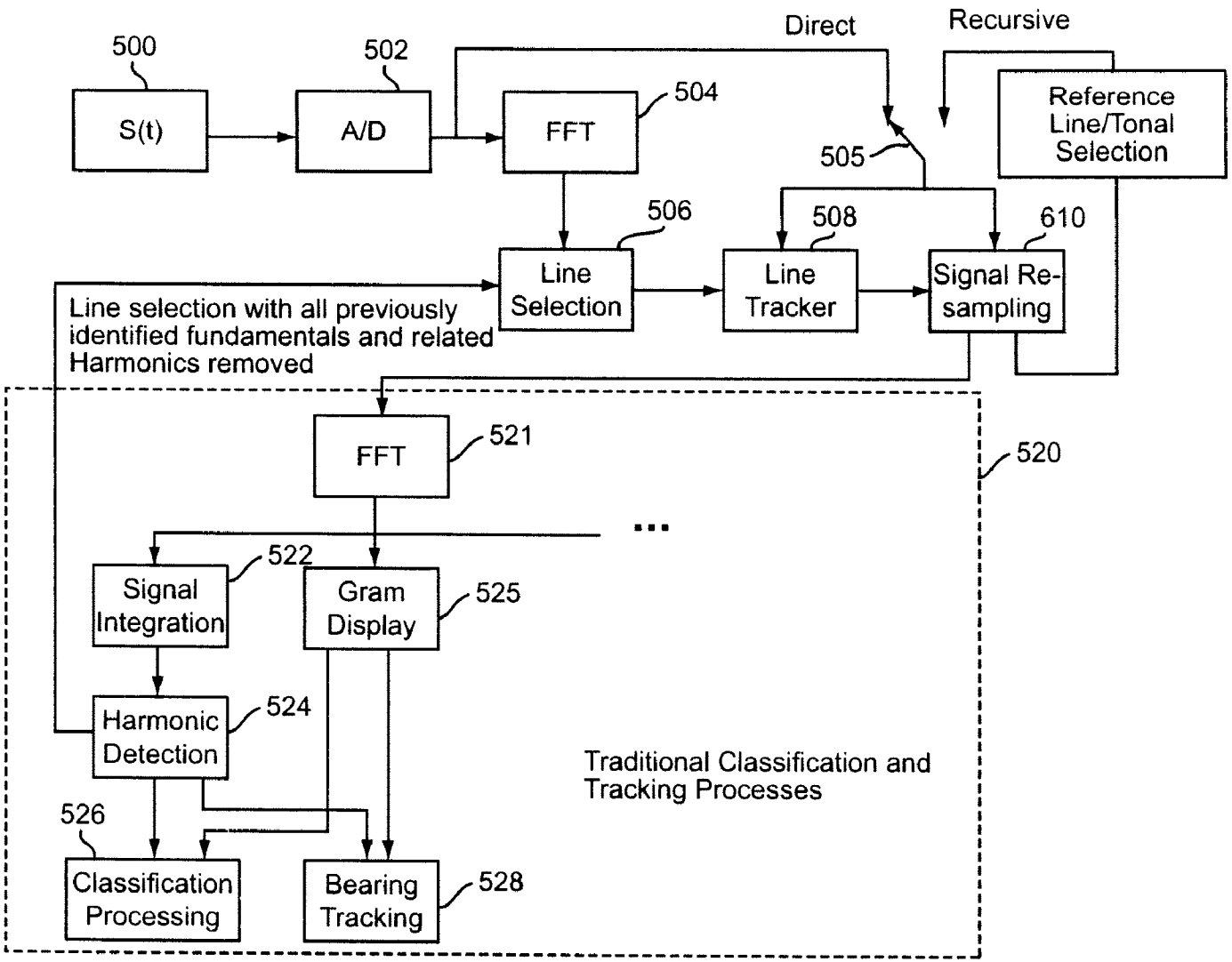
FIG. 5 is a schematic block diagram or flow chart of a preferred time domain implementation embodiment of the invention as applied to an acoustic source classification, tracking and identification arrangement or process.
Figure 6:
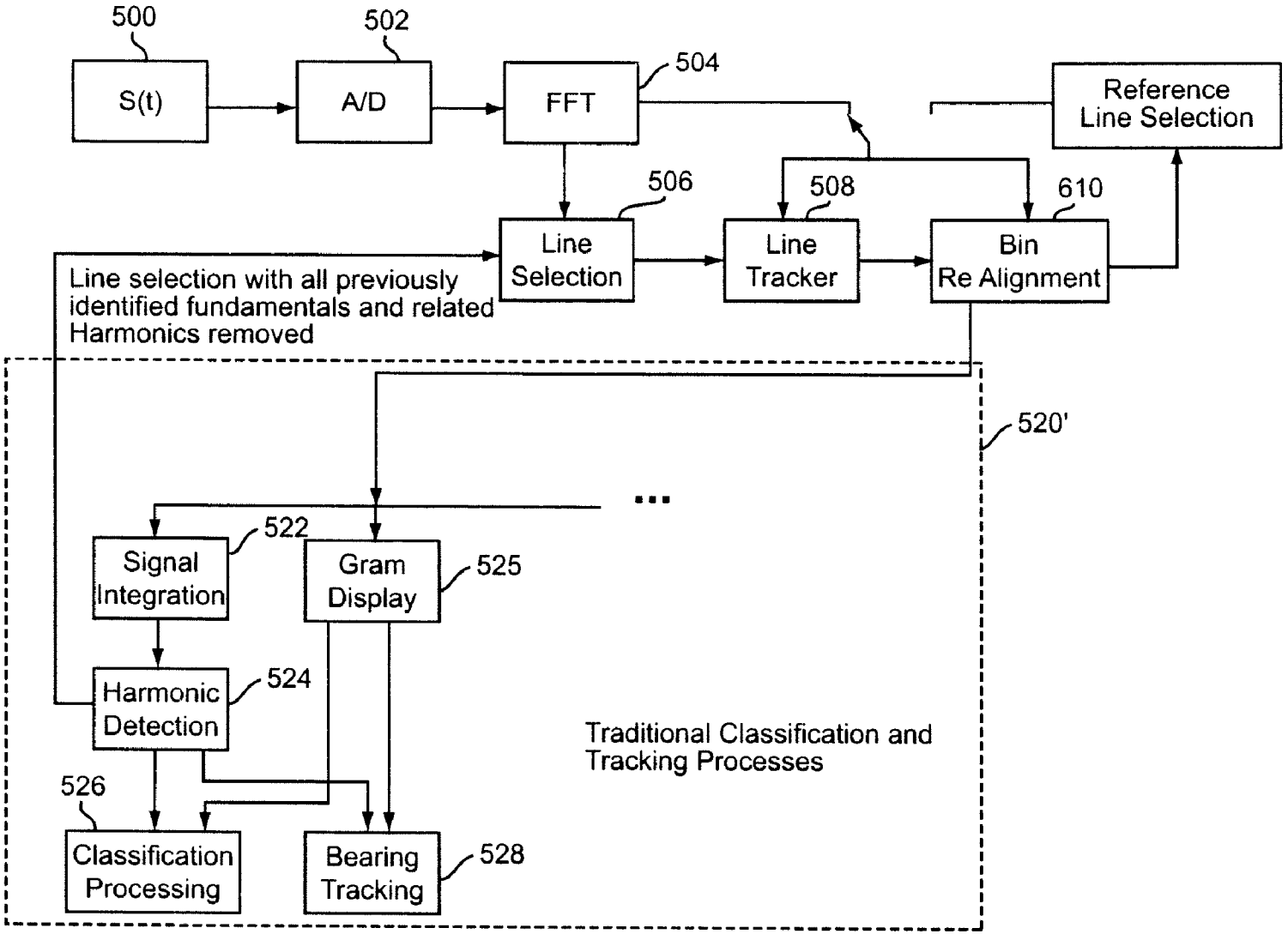
FIG. 6 is a schematic block diagram or flow chart of a preferred frequency domain implementation embodiment of the invention, also as applied to an acoustic source classification, tracking and identification arrangement or process.

An exemplary preferred embodiment of the arrangement of FIG. 4 is depicted in greater detail in FIG. 5 which illustrates a time domain implementation of the invention. It should be understood that signal integration settings, FFT frame size and the like are normally under operator control through algorithms and that automated controls exist for some applications. Further, FIGS. 5 and 6 are to be understood to indicate that the invention is preferably implemented as a front end as a preprocessor with feedback prior to traditional signal processing; the details of the latter being unimportant to an understanding or the successful practice of the invention. Further, it should be appreciated that, in practice, lines are generally selected (e.g. manually by an operator or automatically in response to selected characteristics) before being assigned to trackers as is indicated by the gap between the arrow from "line selection" and the "line tracker".

Starting with a time-varying analog captured signal S(t) 500, an analog-to-digital (A/D) conversion is performed at 502. The signal may then be recorded in digital form. Alternatively, S(t) may be derived from a recording which is preferably in digital form. In either case, the digital data is then provided as a direct input to a line tracker 508 and signal re-sampling circuitry 510, preferably through switch 505 which allows recursive processing of the re-sampled data, the purpose and advantages of which will be described below.

The output of A/D converter 502 is provided as an input to a fast Fourier transform (FFT) processor 504 which determines the frequencies present in S(t) and the relative magnitudes thereof. This information may then be used to select a particular line which corresponds to a frequency which may be unstable and fluctuating (as in the upper graph of FIG. 1) as shown at 506. Variations in the frequency of the selected line are then tracked at 508 and a signal corresponding to the frequency and its variation is used to control the period of signal re-sampling at 510 so that synchronous re-sampling can be performed which accurately tracks the frequency variation of the line. The synchronously re-sampled signal is then provided to another FFT processor 521 the output of which will thus correspond to the lower graph of FIG. 1.

It should be noted that the signal processing which is initiated at FFT 521 may be conventional and may include many known or foreseeable signal processing techniques other than those depicted in FIG. 5 (or FIG. 6). That is, in the absence of the invention, FFT 521 would directly receive the output of A/D converter 502 (e.g. corresponding to the upper graph of FIG. 1) giving rise to the difficulties in observation and isolation of particular lines which are avoided by the synchronous re-sampling provided by the invention. A display 525 (e.g. frequency versus time with pixel intensity used to represent signal strength) or other types of display which may aid in the observation of a processed signal by a trained analyst may be provided which may assist in tracking the bearing of the signal source, as illustrated at 528, or the like. The data developed for the histogram display 525 may also be directly provided to other processing arrangements such as classification processing 526 (following signal integration 522 and harmonic detection 524 which are conventional signal enhancement techniques) which may seek to identify, to a greater or lesser degree, S(t) with previous signal observations. None of this processing collectively depicted at 520 is at all critical or even a requirement for the successful practice of the invention. However, it should be noted that the invention advantageously also uses harmonic detection as feedback to the line selection processing so that apparently constant frequencies which have previously been used as trial reference frequencies for synchronous re-sampling may be removed and need not necessarily be re-used for further processing unless recursive processing for harmonic, sub-harmonic or fundamental frequency signal enhancement as will be described below is desired. This feedback greatly expedites the observation of as many frequencies/lines as possible since removal of related or dependent lines from the line selection processing 506 reduces the remaining possible lines to those corresponding to sources which are unrelated to lines previously observed. Further, due to the synchronous re-sampling provided in accordance with the invention, not only will the frequency corresponding to the currently selected line be stabilized and essentially constant, but all harmonics, sub-harmonics and/or fundamental frequencies will be stabilized to the extent of having frequency fluctuations of the currently selected line removed and will be either constant or fluctuating in correspondence with other dependencies as in the generator/motor/pump example alluded to above; allowing such dependencies to be identified more readily. Additionally, while signal integration may provide some signal enhancement in the absence of synchronous re-sampling in accordance with the invention if the SNR of the line is sufficiently great, substantial signal processing gain may be derived through suitable control of the integration period when synchronous re-sampling in accordance with the invention is employed, as described above which also enhances and facilitates the harmonic detection process 524.

Referring now to FIG. 6, an exemplary frequency domain implementation of the invention will now be described. It will be noted from a comparison of FIGS. 5 and 6 that most of the functional elements/blocks are the same and reference numerals used in FIG. 5 have been retained in FIG. 6. However, it will be noted that FFT 521 is not present among the traditional classification and tracking processes 520' in FIG. 6. FIG. 6 also differs from FIG. 5 in that the signal re-sampling apparatus or process 510 of FIG. 5 is replaced by a bin realignment apparatus or process 610. However, it should be appreciated that bin re-alignment 610 of FIG. 6 also preferably includes synchronous re-sampling as illustrated at 510 of FIG. 5 as will be described below. The recursive processing loop of FIG. 5 is also omitted in the interest of clarity.

It will also be appreciated from a comparison of FIGS. 5 and 6 that the input to line tracker 508, which is responsive to line selection 506 which, in turn, receives feedback from harmonic detector 524, also receives an input from FFT 504 whereas, in the time domain implementation of FIG. 5, the output of the A/D converter 502 is input thereto. As indicated above, the output of FFT 504 corresponds to the upper graph of FIG. 1 Since, as in the embodiment of FIG. 5, line tracker 508 provides information representing the instantaneous frequency of a selected line (at the center of an FFT frame). The synchronous re-sampling is then performed in the frequency domain by re-allocating the energy in the FFT bins; the shift being proportional to the ratio of the reference frequency bin to the actual bin number such that the spectral line of interest in S(t) consistently falls within a very narrow range or "bin". In other words, if a frequency "bin" corresponding to a selected line (e.g. 120 of FIG. 1) is thus realigned by synchronous re-sampling in accordance with variations in the frequency of that selected line, the apparent frequency of that line will appear to be substantially constant and the spectrum of S(t) will be stabilized as illustrated in the lower graph of FIG. 1. As alluded to above, any frequency component corresponding to any line in the upper graph of FIG. 1, regardless of the frequency variation it may exhibit, can be made to appear not only constant but of any desired frequency in the lower graph of FIG. 1 (which may be considered as the upper and lower graphs of FIG. 1 having different frequency scales). (This mode of operation might be well-visualized as being similar to moving a bucket to always catch a stream of fluid which is moving in position but defining the position of the stream with reference to the bucket.) The signal enhancement described above will also obtain for the frequency domain implementation of the invention since the power of a given line can be made to fall entirely within a given frequency bin.

It should also be noted that in some cases lines (e.g. harmonics, sub-harmonics or a fundamental of the originally detected tonal) will be enhanced but exhibit some instability in addition to that of the reference tone, yielding less than optimal enhancement. An example would be an induction motor powered by a generator and possibly driving a pump, as alluded to above. Recursive processing in accordance with the invention in which the output time series from one stage can be used as the input to the next stage of the process can be performed in such a case. That is, the invention may allow detection of an otherwise undetectable tone related to an originally detected tonal but that tone may show variation in frequency in the re-sampled signal where the originally detected tonal frequency is apparently constant. The additional frequency variation in the tone can then be individually tracked either from the original signal or, preferably, the re-sampled signal and may yield information in regard to operational or functional relationships between individual acoustic sources within a composite acoustic signal source, such as in the above example of a pump driven by a motor which is powered by a generator.

Such recursive processing (in addition to recursive hypothesis testing in accordance with the basic principles of the invention alluded to above) can be advantageous in reducing the cost of subsequent re-sampling operations since smaller time shifts are required in such subsequent re-sampling steps as well as providing an indication of mechanical and other functional interrelationships which are of particular importance in classification of complex machinery and/or identification of composite acoustic sources.

As alluded to above, under some circumstances, it is possible to identify variations in tonal level as a function of frequency. Such a variation usually occurs when the tonal passes through a resonance which can be caused by a hull, mounting plate or other paths between the source and the environment. Such amplitude variations, when they occur, can also be invaluable for source classification and identification particularly since they may often be unique to a previously observed source for which an identity may be known. Identification and quantification of such amplitude variation is also facilitated by stabilization of tones through synchronous re-sampling in accordance with the invention.

In view of the foregoing, it is seen that the invention provides a technique for stabilizing and rendering substantially constant for purposes of signal processing and/or analysis tones which may be subject to substantial instability and/or frequency variation. Once a relatively strong tonal is detected, synchronous re-sampling allows detection and achievement of signal processing gain relative to noise of any and all related or coupled tonal sources even if originally undetectable due to low SNR. The apparatus and process in accordance with the present invention are very simple and straightforward as indicated in FIG. 4, requiring only a sequence of line tracking processing, itself well-understood in the art, synchronous re-sampling in accordance with the frequency of the tonal tracked by the line tracker to stabilize the frequency of the tonal and related frequency signal components and some form of spectral analysis of a portion or possibly only a single line thereof to observe the related frequencies and possibly the behavior thereof over time or with frequency.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A method of acoustic signal processing including steps of detecting a tonal within said acoustic signal, wherein said acoustic signal originates from one or more objects or the physical environment, sampling said acoustic signal at a rate approximating an instantaneous frequency of said tonal, setting an integration period of fast Fourier transform frame size for the signal resulting from said sampling step in accordance with an approximation of an intrinsic bandwidth of said tonal, and observing a portion of a spectrum of said acoustic signal in accordance with a result of said setting step.

2. The method as recited in claim 1, wherein said detecting step further includes sampling of said acoustic signal consistent with Nyquist criteria and recording resulting samples, and said step of sampling said acoustic signal at a rate approximating an instantaneous frequency of said tonal comprises re-sampling the acoustic signal to stabilize the detected tonal and components with any constant frequency ratio to the detected tonal.

3. The method as recited in claim 1 including the further step of observing amplitude variation over time of said tonal.

4. The method as recited in claim 1 including the further step of observing amplitude variation over time of said portion of the spectrum of said acoustic signal.

5. The method as recited in claim 1, wherein frequency changes of said tonal are instability driven.

6. The method as recited in claim 1, wherein frequency changes of said tonal are speed driven.

7. The method of claim 6 wherein said method is performed recursively for a plurality of unrelated tonals.

8. The method of claim 1 wherein said method is performed recursively for a plurality of related tonals.

9. The method of claim 1 wherein said method subsequent to said detecting step is performed using time domain data.

10. The method of claim 1 wherein said method subsequent to said detecting step is performed using frequency domain data.

11. The method as recited in claim 1, including a further step of performing a spectral analysis on said acoustic signal.

12. The method as recited in claim 1, including a further step of performing a spectral analysis on a result of said step of sampling said acoustic signal at a rate approximating an instantaneous frequency of said tonal.

13. The method as recited in claim 2, including a further step of performing a spectral analysis on a result of said re-sampling step.

14. The method as recited in claim 1, including a further step of selecting a tonal from results of said detecting step.

15. The method as recited in claim 14, including a further step of tracking said tonal selected in said selecting step.

16. The method as recited in claim 1, wherein said observing step includes a further step of determining an acoustic signature from said spectrum of said acoustic signal in accordance with a result of said setting step.

17. A method of acoustic signal processing comprising steps of sampling said acoustic signal, wherein said acoustic signal is originates from one or more objects or the physical environment, performing a spectral analysis of said acoustic signal, selecting a reference tone from a result of said step of performing spectral analysis, tracking frequency of said reference tone, re-sampling said acoustic signal in accordance with a result of said tracking step to stabilize the selected tone and components of said acoustic signal having any constant frequency ratio to said reference tone, and observing a portion of a spectrum of a result of said re-sampling step.

18. The method as recited in claim 17, including a further step of storing results of said sampling step.

19. The method as recited in claim 17, wherein said observing step includes a further step of determining an acoustic signature from said spectrum of said acoustic signal in accordance with a result of said setting step.

20. The method as recited in claim 17, including the further step of setting an integration period of fast Fourier transform frame size for the signal resulting from said re-sampling step in accordance with an approximation of an intrinsic bandwidth of said tonal.

* * * * *